US008657116B2

(12) United States Patent
Buresch et al.

(10) Patent No.: US 8,657,116 B2
(45) Date of Patent: Feb. 25, 2014

(54) POINT OF SALE PACKAGING ASSEMBLY

(75) Inventors: Robert Michael Buresch, Strykersville, NY (US); Justin Petit, Depew, NY (US)

(73) Assignee: Mattel, Inc., El Segundo, CA (US)

( * ) Notice: Subject to any disclaimer, the term of this patent is extended or adjusted under 35 U.S.C. 154(b) by 76 days.

(21) Appl. No.: 13/160,550

(22) Filed: Jun. 15, 2011

(65) Prior Publication Data

US 2012/0318696 A1 Dec. 20, 2012

(51) Int. Cl.
*B65D 73/00* (2006.01)

(52) U.S. Cl.
USPC ..... 206/495; 206/478; 206/481; 206/488; 206/493

(58) Field of Classification Search
USPC ..... 206/205, 477, 483, 481, 769, 231, 478, 206/479, 482, 488, 493, 495; 220/324; 446/75–77; 24/104, 90.5, 543, 573.09
See application file for complete search history.

(56) References Cited

U.S. PATENT DOCUMENTS

| | | | | | |
|---|---|---|---|---|---|
| 156,721 | A | * | 11/1874 | Young | 24/104 |
| 293,658 | A | * | 2/1884 | Maedel | 24/114.8 |
| 751,824 | A | * | 2/1904 | Zolles | 206/756 |
| 1,057,532 | A | * | 4/1913 | Elliott | 24/104 |
| 1,574,192 | A | * | 2/1926 | Gutterman | 206/479 |
| 1,599,685 | A | * | 9/1926 | Spaeth | 220/210 |
| 1,643,421 | A | * | 9/1927 | Rowan | 206/482 |
| 2,226,409 | A | * | 12/1940 | Patterson et al. | 206/478 |
| 2,856,806 | A | * | 10/1958 | Gibbons, Jr. | 411/341 |
| 3,429,985 | A | | 2/1969 | Czigler | |
| 3,695,140 | A | * | 10/1972 | Noble | 411/352 |
| 3,926,089 | A | * | 12/1975 | Ruebig et al. | 411/340 |
| 4,631,783 | A | | 12/1986 | Hayashi | |
| 4,840,528 | A | * | 6/1989 | Doom | 411/351 |
| 4,985,968 | A | | 1/1991 | Hooper | |
| 5,110,138 | A | * | 5/1992 | Vandermeide | 273/391 |
| 5,136,758 | A | | 8/1992 | Wilcox et al. | |
| D338,684 | S | * | 8/1993 | Lorber | D19/65 |
| 5,411,138 | A | | 5/1995 | Klawiter | |
| 5,505,351 | A | | 4/1996 | Najarian | |
| 5,695,380 | A | | 12/1997 | Morrison | |
| 5,782,090 | A | | 7/1998 | Locke | |
| 6,082,601 | A | * | 7/2000 | Standish | 224/569 |
| 6,367,128 | B1 | | 4/2002 | Galkiewicz et al. | |
| 6,520,828 | B2 | | 2/2003 | Ferrigno | |
| 6,588,074 | B2 | | 7/2003 | Galkiewicz et al. | |
| 7,527,149 | B2 | | 5/2009 | Wu | |
| 7,789,235 | B2 | | 9/2010 | Trapp | |

(Continued)

OTHER PUBLICATIONS

International Search Report for PCT/US2012/040128, Dec. 14, 2012.

*Primary Examiner* — J. Gregory Pickett
*Assistant Examiner* — Mollie Llewellyn
(74) *Attorney, Agent, or Firm* — Edell, Shapiro & Finnan, LLC

(57) ABSTRACT

A point of sale packaging assembly includes a support portion for supporting a toy and a fastener device. The support portion has opposing surfaces and a slot extending therethrough and configured for receiving a looped extension member of a toy. The fastener device includes an elongate portion and a base portion pivotally coupled to the elongate portion. The elongate portion includes a distal end portion releasably securable to an engagement surface on the base portion. The elongate portion is configured to be received through the looped extension member of the toy so that the toy is releasably coupleable to the support portion.

16 Claims, 10 Drawing Sheets

(56) References Cited

U.S. PATENT DOCUMENTS

| | | | | |
|---|---|---|---|---|
| 7,954,641 | B2 | 6/2011 | Calendrille | |
| 2003/0015630 | A1 * | 1/2003 | Fishler | 248/102 |
| 2007/0124896 | A1 | 6/2007 | Wong et al. | |
| 2009/0026105 | A1 | 1/2009 | Wu | |
| 2009/0032047 | A1 * | 2/2009 | Defenbaugh et al. | 132/210 |
| 2010/0050394 | A1 | 3/2010 | Fried | |
| 2010/0065451 | A1 * | 3/2010 | Calendrille, Jr. | 206/315.1 |
| 2010/0084301 | A1 * | 4/2010 | Trapp et al. | 206/481 |

* cited by examiner

POINT OF SALE PACKAGING ASSEMBLY

FIELD OF THE INVENTION

The present invention relates to a packaging assembly, and in particular, a packaging assembly including a fastener device having an elongate portion extending through a loop portion of a toy so that the toy is releasably secured to a support portion of a package.

BACKGROUND OF THE INVENTION

Conventional packaging assemblies, such as corrugated boxes, plastic bags and boxes, backer boards, etc, typically enclose or protect the item being packaged for storage, transport and/or point of purchase display. The item is sometimes secured to the packaging assembly using wire, bands, or quarter-turn fasteners. Because of the nature of plush/soft items, lacking any real rigid internal structure, quarter-turn fasteners are not generally used for such items. Although wire and/or bands are relatively effective in securing item, including plush items, to the packaging, it is cumbersome and time consuming to properly secure the item to the packaging with such fasteners. Moreover, it is often difficult for the end-purchaser of the packaged item to easily remove such conventional fasteners and extract the item from the packaging.

In addition, such conventional fasteners and/or the packaging are typically destroyed or damaged upon removal of the packaged item. Thus, should the item be returned and/or require re-packaging, new packaging must be used in order for the item to be resealable.

Therefore, there is a need for a packaging system that permits a toy to be easily and effectively secured to a packaging assembly. In addition, there is a need for a fastener device usable with a toy and packaging that is easily removed and/or reusable.

SUMMARY OF THE INVENTION

The present invention relates to a toy housed in a point of sale package. The toy includes a main body and a loop portion connected to the main body. The point of sale package for the toy includes a support portion for supporting the toy in the package. The support portion has a slot. The loop portion of the toy extends through the slot. A fastener device includes an elongate portion extending through the loop portion of the toy so that the toy is releasably secured to the support portion of the package.

In one embodiment, the fastener device includes a base portion pivotally coupled to the elongate portion. The elongate portion includes a distal end portion releasably securable to the base portion. In one implementation, the base portion of the fastener includes an engagement surface, and the distal end portion of the elongate portion includes a lock member releasably securable to the engagement surface. In one implementation, the base portion of the fastener has a generally circular configuration. In one implementation, the elongate portion of the fastener is pivotally coupled to the base portion via a living hinge.

In one embodiment, the support portion of the package includes first and second opposing surfaces. The main body of the toy is disposed adjacent and extending outwardly from the first surface, and the loop portion of the toy is disposed adjacent and extending outwardly from the second surface. In one implementation, the elongate portion of the fastener engages the second surface of the support portion.

The present invention also relates to a combination of a toy housed in a point of sale package. The toy has a main body and an extension member connected to the main body. The point of sale package for the toy includes a support portion having first and second opposing surfaces and a slot extending therethrough. The main body of the toy is disposed adjacent and extending outwardly from the first surface of the support portion. The extension member of the toy extends through the slot and outwardly from the second surface. A lock mechanism is releasably coupled to the extension member of the toy so that the toy is releasably secured to the support portion.

In one embodiment, the lock mechanism includes a lock ring and an elongate portion pivotally coupled to the lock ring. In one implementation, the lock ring is integrally formed with the elongate portion. In one implementation, the elongate portion is pivotally coupled to the lock ring via a living hinge. In one implementation, the extension member of the toy includes a loop portion, and the elongate portion of the lock mechanism is received in and extends through the loop portion. In one implementation, the lock ring has a diameter and the slot in the support portion of the package has a length less than the diameter of the lock ring.

The present invention also relates to a point of sale packaging assembly. The assembly includes a support portion for supporting a toy and a fastener device. The support portion has first and second opposing surfaces and a slot extending therethrough. The slot is configured for receiving a looped extension member of a toy. The fastener device includes an elongate portion and a base portion pivotally coupled to the elongate portion. The elongate portion includes a distal end portion releasably securable to an engagement surface on the base portion. The elongate portion is configured to be received through the looped extension member of the toy so that the toy is releasably coupleable to the support portion.

In one embodiment, the elongate portion is coupled to the base portion of the fastener and pivotal about an arc of about 180°. In one implementation, the elongate portion is pivotally movable between a first position extending outwardly from the base portion, and a second position spanning across the diameter of the base portion. In one implementation, the base portion engages the second surface of the support portion.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 1:
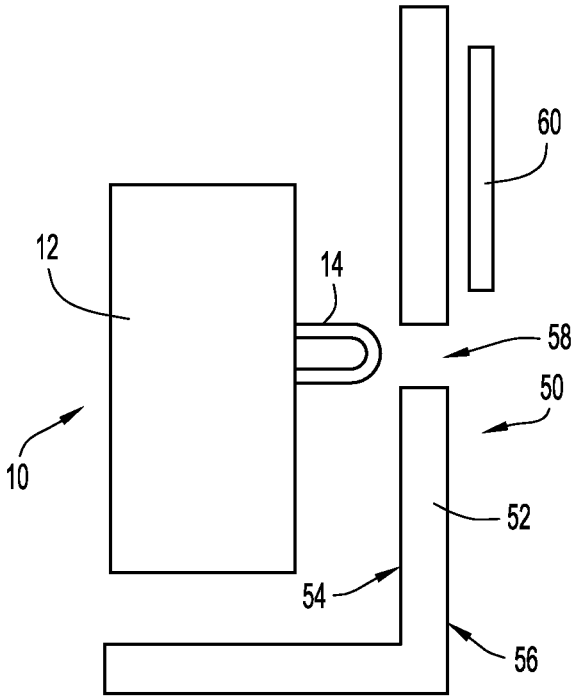
FIG. 1 illustrates a schematic diagram of a toy coupleable to a point of sale package according to an embodiment of the present invention.
Figure 2:
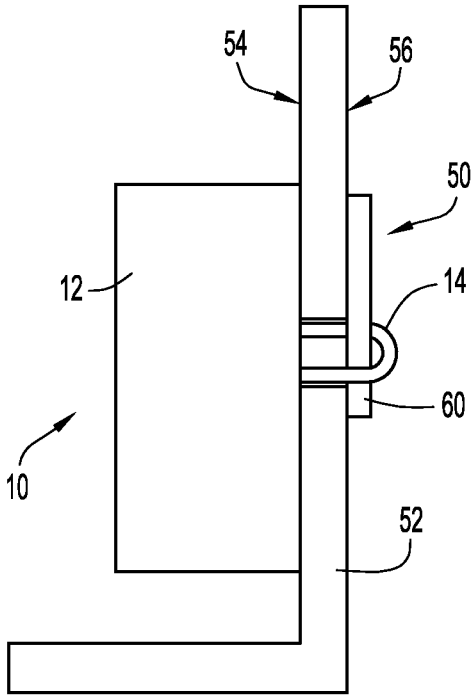
FIG. 2 illustrates a schematic diagram of the toy of FIG. 1 coupled to the point of sale package by a fastener.

FIGS. 1 and 2 illustrate schematic diagrams of a combination of a toy 10 housed in a point of sale package 50 in accordance with the present invention. The toy 10 includes a main body 12 and an extension member 14 connected to the main body 12. The point of sale package 50 for the toy 10 includes a support portion 52 having first and second opposing surfaces 54, 56, and a slot 58 extending therethrough. When coupled to the package 50, the main body 12 of the toy 10 is disposed adjacent and extends outwardly from the first surface 54 of the support portion 52. The extension member 14 of the toy 10 extends through the slot 58 and outwardly from the second surface 56. A lock mechanism 60 is releasably coupled to the extension member 14 of the toy 10 so that the toy 10 is releasably secured to the support portion 52, as shown in FIG. 2.

Figure 3:
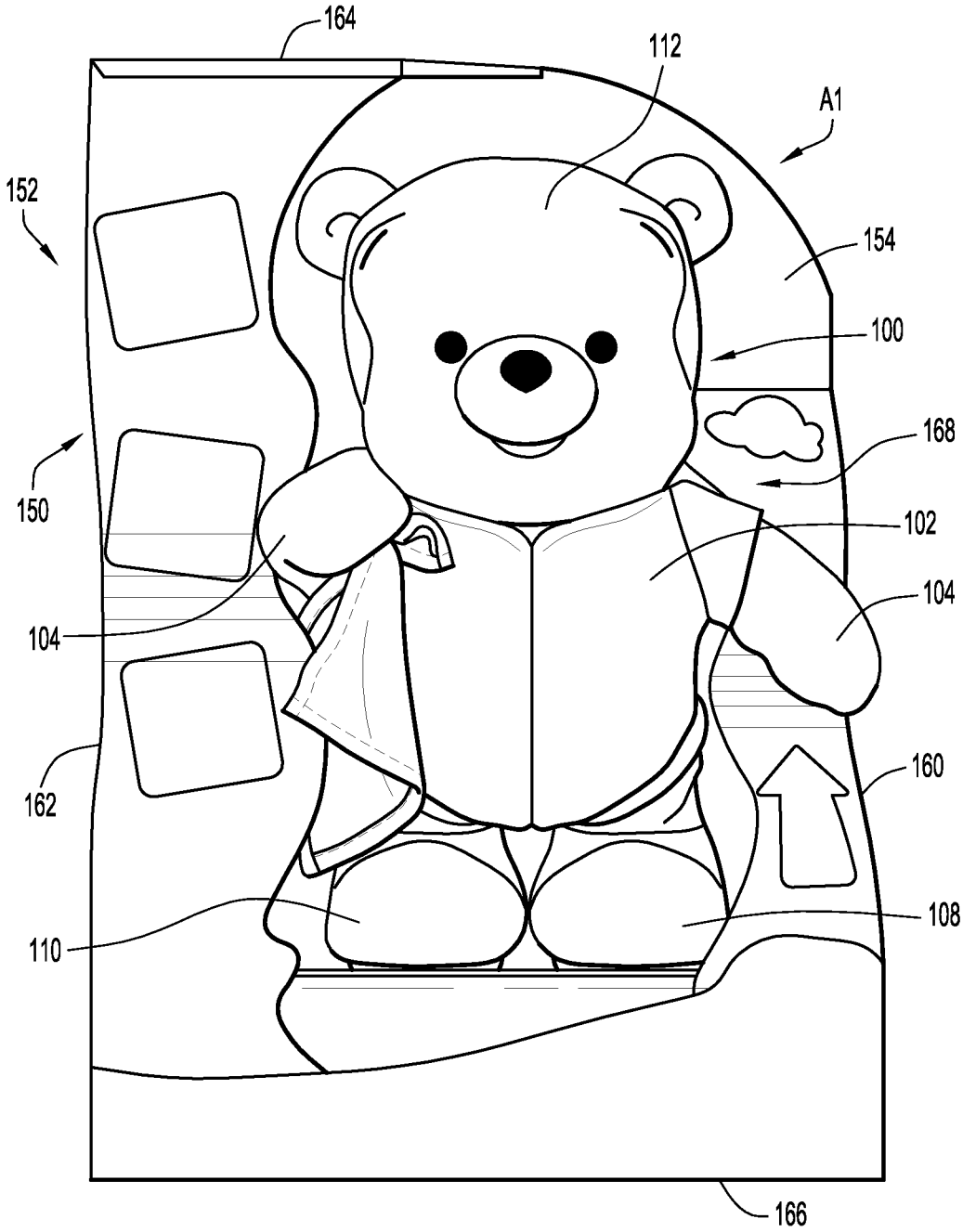
FIG. 3 illustrates a front view of a point of sale packaging assembly according to an embodiment of the present invention.
Figure 4:
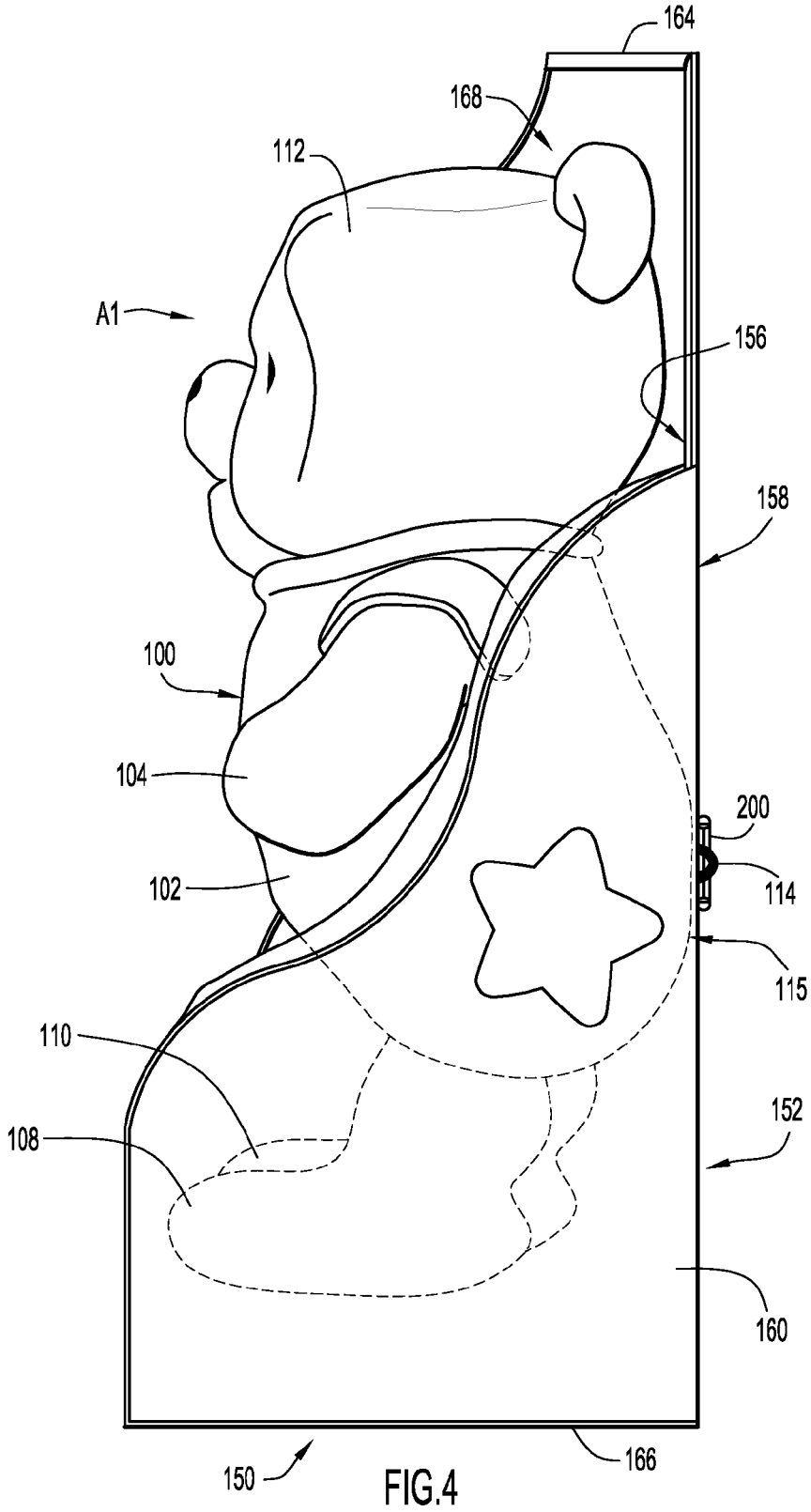
FIG. 4 illustrates a side view of the point of sale packaging assembly of FIG. 3 with portions shown in phantom.

Referring to FIGS. 3 and 4, a point of sale packaging assembly A1 according to another embodiment of the present invention is illustrated. The assembly A1 includes a toy 100 and a package 150. The toy 100 includes a main body or torso 102, arms 104, legs 108, 110 and a head 112. An extension member or loop portion 114 is connected to and extends outwardly from a back side 115 (shown in phantom) of the torso 102.

The package 150 includes a support portion 152 configured for supporting or being coupled to the toy 100. In one embodiment, the support portion 152 includes a back wall 154 including opposing front and rear surfaces 156, 158, spaced side walls 160, 162 extending outwardly from the front surface 156, a top wall 164 extending outwardly from the front surface 156, and a bottom wall 166 extending outwardly from the front surface 156. The back wall 154, side walls 160, 162, top wall 164 and bottom wall 166 collectively define a receiving area 168 in which the toy 100 is disposed when coupled to the package 150.

Figure 5:
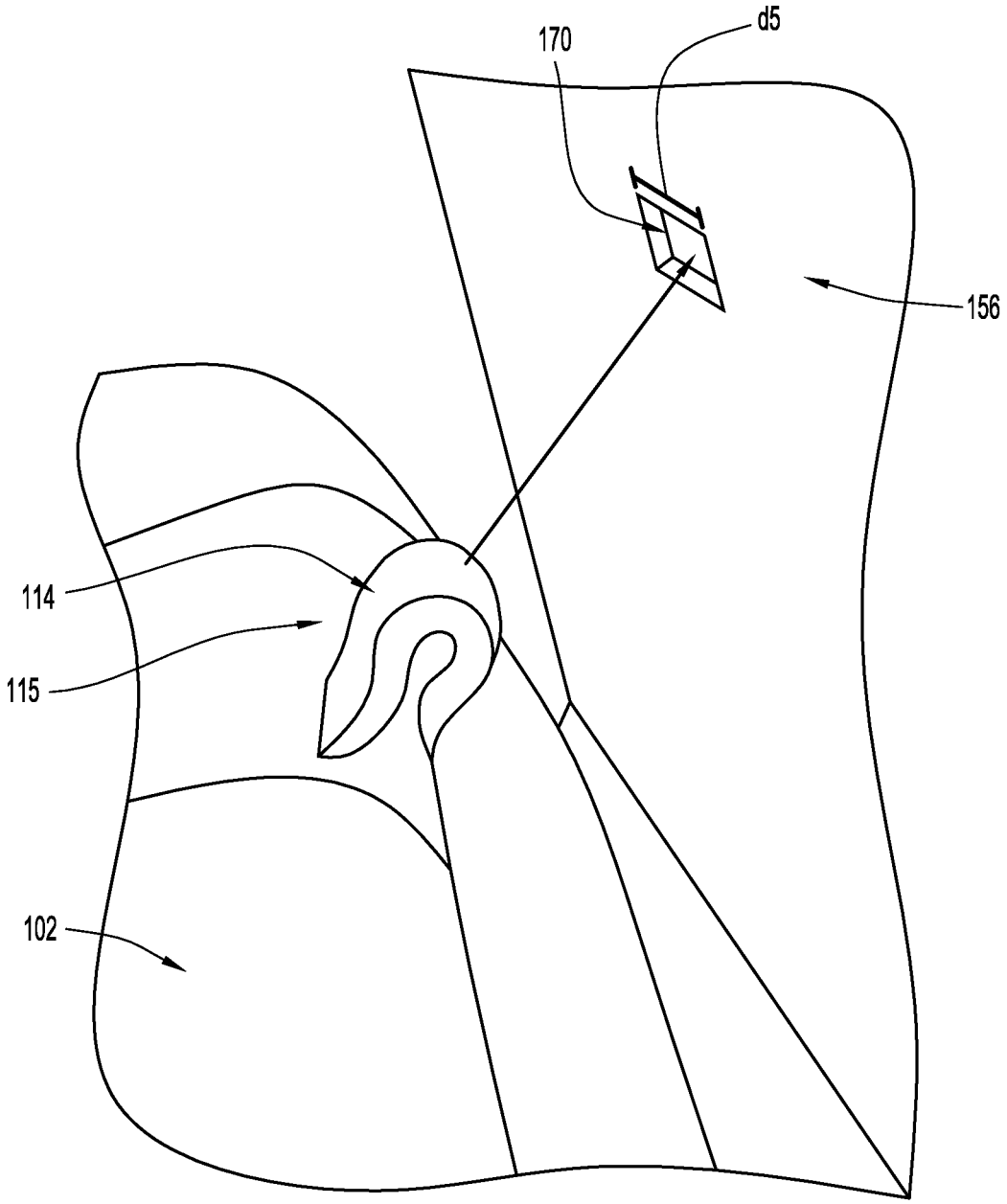
FIG. 5 illustrates a perspective fragmentary view of portions of a toy and a support portion of a package according to an embodiment of the present invention.
Figure 6:
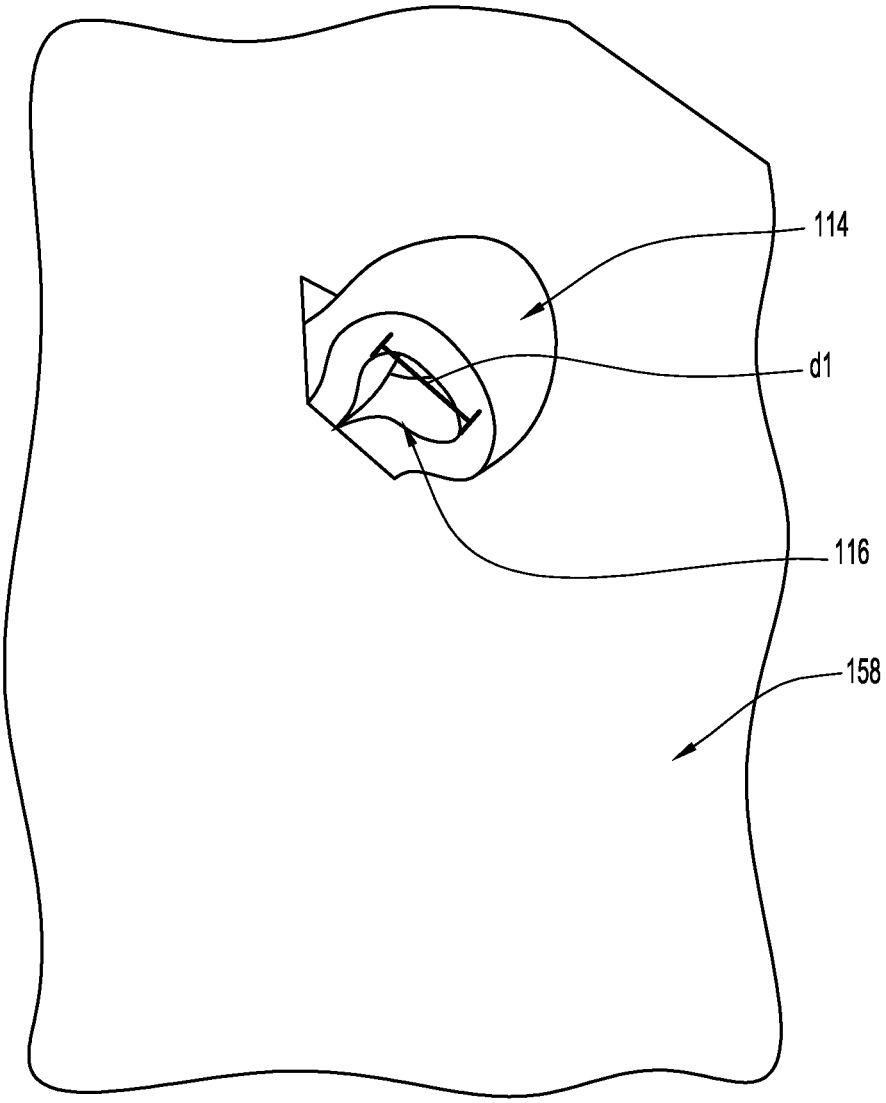
FIG. 6 illustrates a perspective fragmentary view of the support portion of the package of FIG. 5 and showing a loop portion of the toy extending outwardly from the support portion.

Referring to FIGS. 5 and 6, the back wall 154 defines a slot 170 extending therethrough and between the front surface 156 (shown in FIG. 5) and the rear surface 158 (shown in FIG. 6). The loop portion 114 of the toy 100 is received in and extends through the slot 170. Thus, the torso 102 of the toy 100 is disposed adjacent and extends outwardly from the front surface 156 of the back wall 154 and within the receiving area 168 (as shown in FIGS. 3 and 4), and the loop portion 114 of the toy 100 is adjacent and extends outwardly from the rear surface 158 of the back wall 154. The loop portion 114 defines an opening 116 having a diameter d1. A fastener device 200 (described in further detail below) extends through the opening 116 of the loop portion 114 of the toy 100, so that the toy 100 is releasably secured to the support portion 152 of the package 150. The fastener device 200 engages the rear surface 158 of the support portion 152 when the toy 100 is coupled to the package 150, as shown in FIG. 4.

Figure 7:
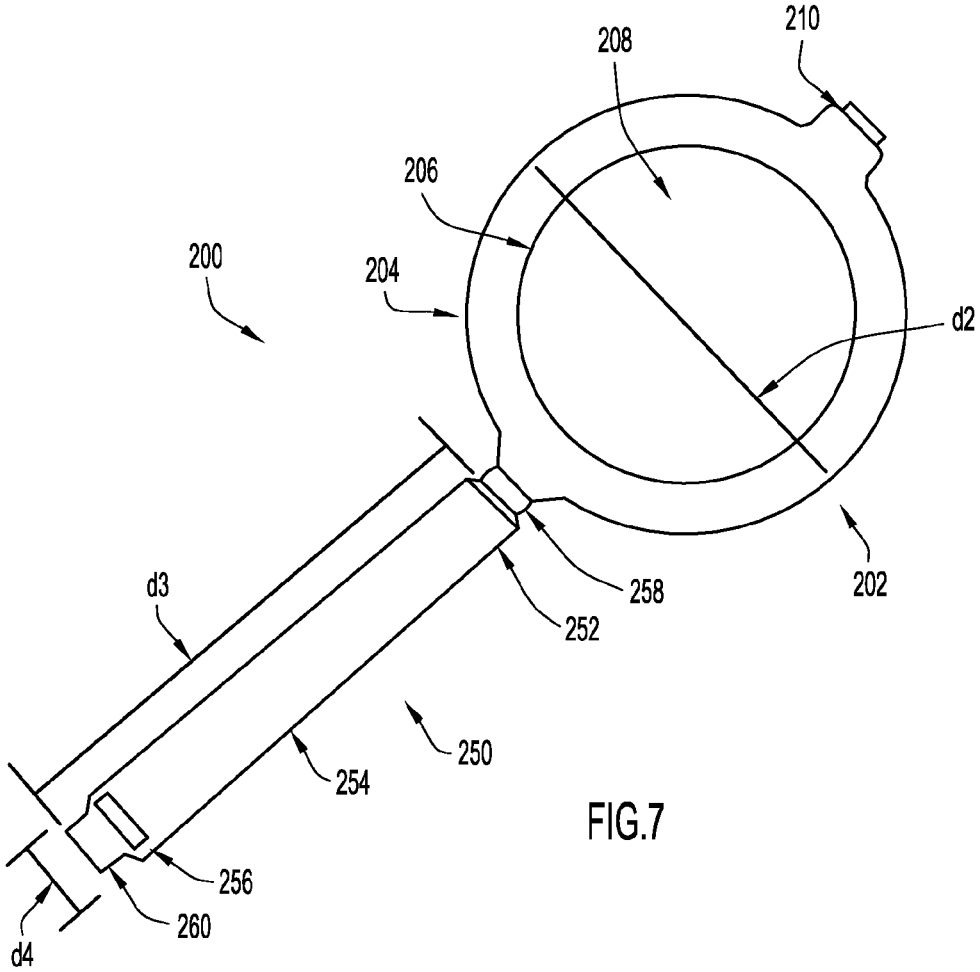
FIG. 7 illustrates a perspective view of a fastener device including a base portion and an elongate portion according to an embodiment of the present invention.

Referring to FIG. 7, the fastener device 200 of the present invention usable with the package 150 is illustrated. The fastener device 200 includes a lock ring or base portion 202 and an elongate portion 250. In one embodiment, the base portion 202 includes an outer edge 204 defining a perimeter thereof, and an inner edge 206 defining an opening 208. In one implementation, the base portion 202 has a generally circular configuration having a diameter d2.

The elongate portion 250 includes an end portion 252 pivotally coupled to the outer edge 204 of the base portion 202, a central portion 254, and an opposite distal end portion 256. In one implementation, the elongate portion 250 and the base portion 202 are integrally formed, and the end portion 252 of the elongate portion 250 is pivotally coupled to the base portion 202 via a living hinge 258. The elongate portion 250 has a length d3 and a width d4. The length d3 of the elongate portion 250 is greater than the diameter d2 of the base portion 202. Further, the slot 170 in the support portion 152 has a length d5 (shown in FIG. 5) less than the diameter d2 of the base portion 202. The fastener device 200 of the present invention may be formed from any appropriate material. For example, fastener device 200 may be formed from a molded plastic material, the elongate portion 250 and the base portion 202 being integrally formed together in a plastic molding apparatus.

Figure 8:
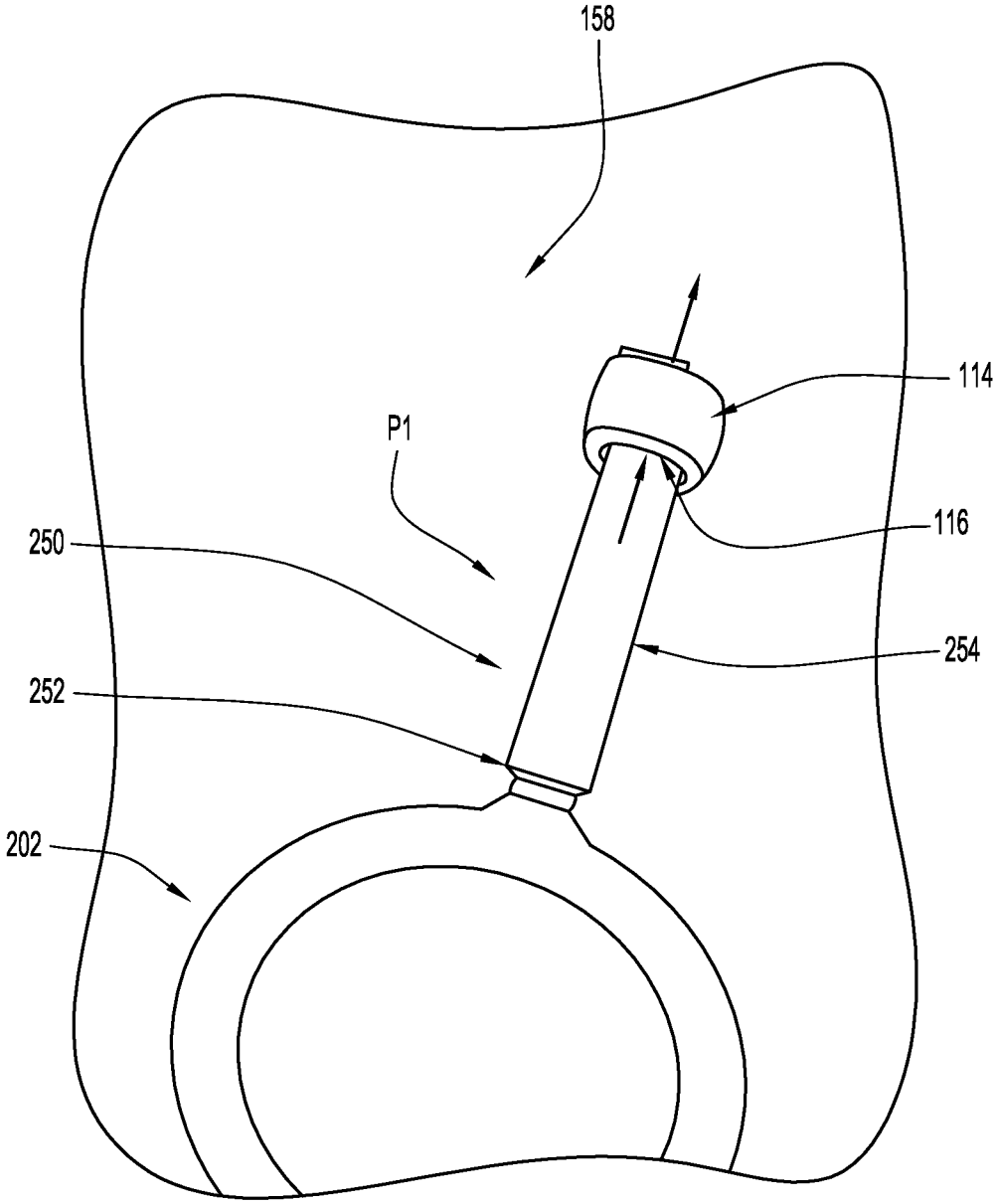
FIG. 8 illustrates a perspective view of the elongate portion of the fastener device of FIG. 7 being received in the loop portion of the toy.
Figure 9:
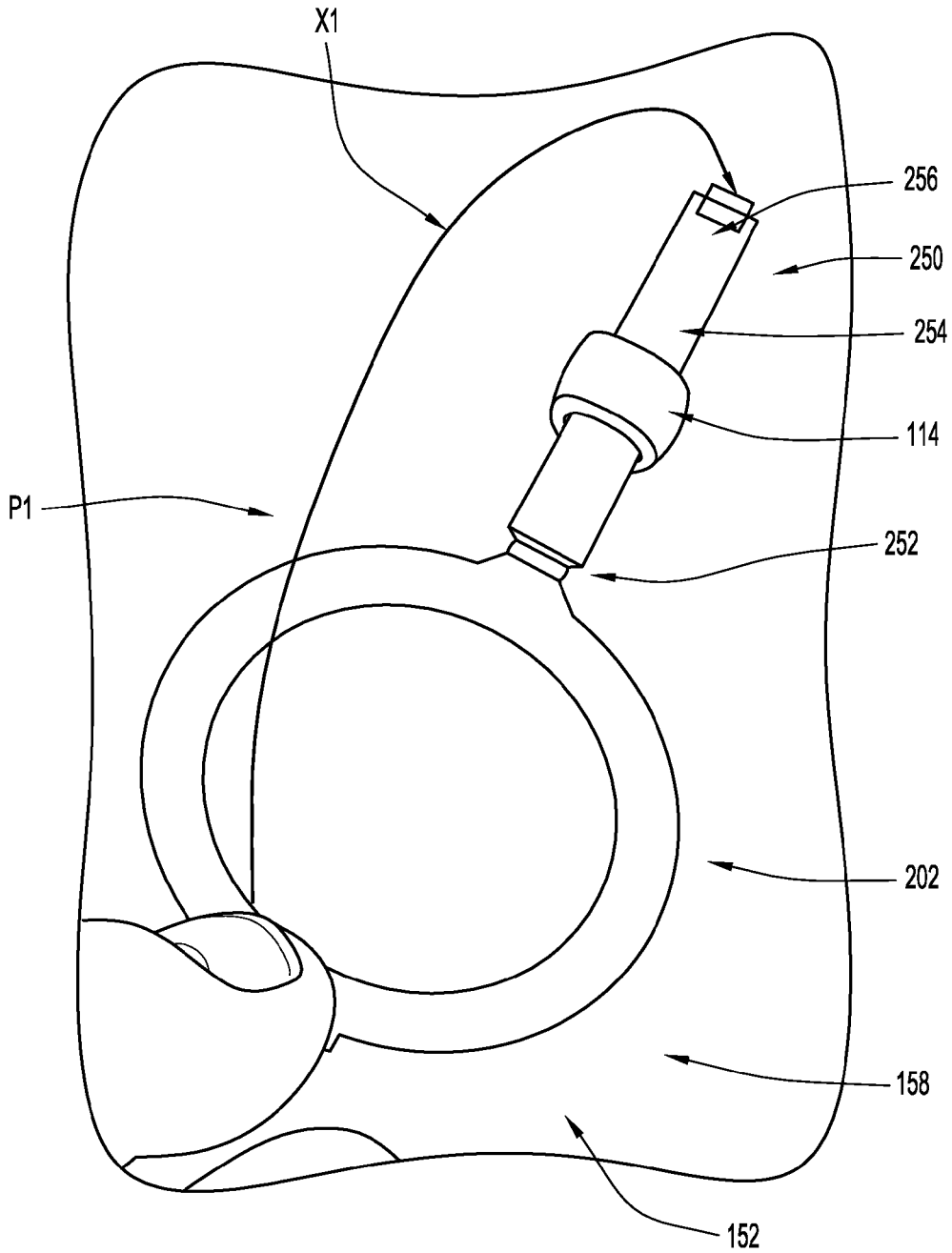
FIG. 9 illustrates another perspective view of the fastener device of FIG. 8 received in the loop portion of the toy.

In order to couple the toy 100 to the package 150, the loop portion 114 of the toy 100 is inserted through the slot 170 of the support portion 152 of the package 150, as described above and shown in FIG. 6. As shown in FIGS. 8 and 9, the distal end portion 256 of the elongate portion 250 is receivable in and fed through the opening 116 of the loop portion 114 of the toy 100 until the loop portion 114 is disposed around the central portion 254 of the elongate portion 250. Thus, the width d4 of the elongate portion 250 is less than a diameter d1 of an opening 116 defined by the loop portion 114.

With continued reference to FIG. 9, the base portion 202 may then be folded or pivoted upwardly and away from the rear surface 158 of the support portion 152 of the package. In one implementation, the base portion 202 is pivotal relative to the elongate portion 250 about an arc of about 180°, as shown by arc X1.

Figure 10:
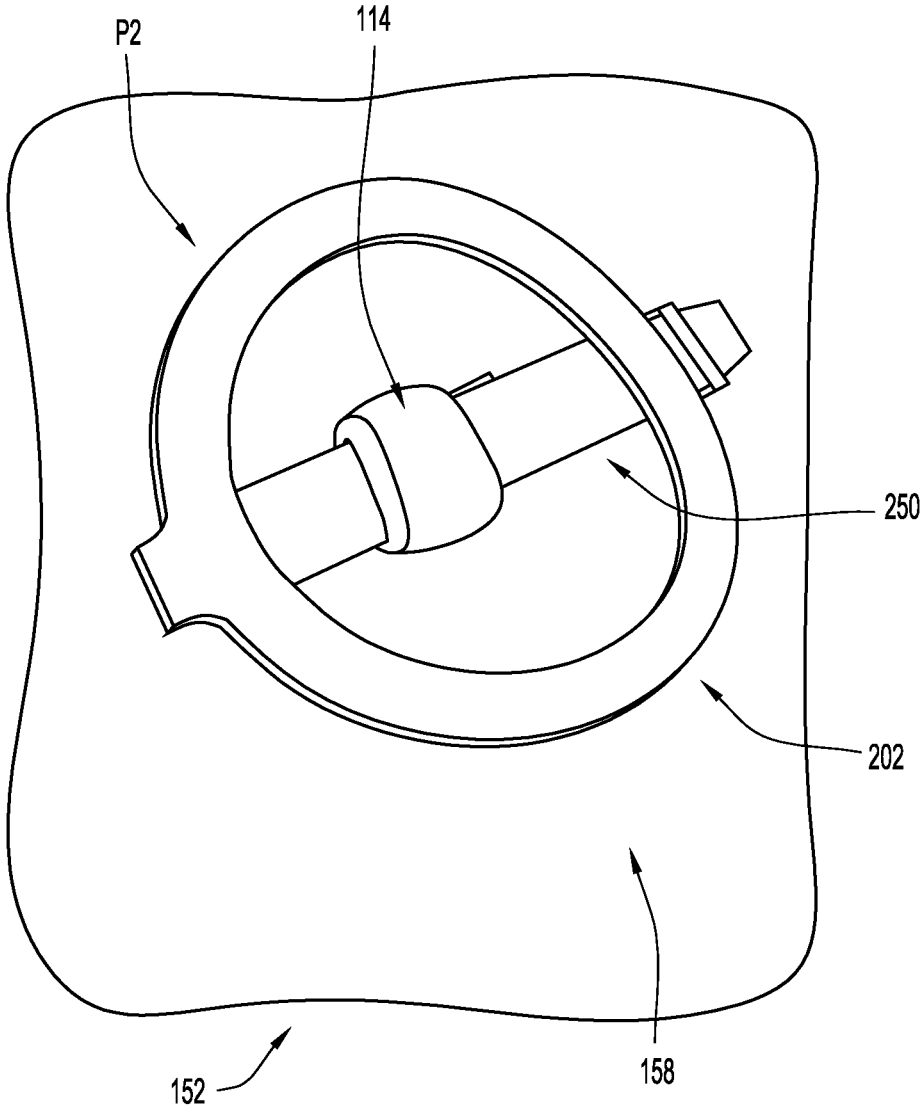
FIG. 10 illustrates another perspective view of the fastener device of FIG. 9 showing an engagement surface of the base portion releasably secured to a lock member of the elongate portion.

Referring again to FIG. 7, the distal end portion 256 of the elongate portion 250 includes a lock member 260, which is releasably securable to an engagement surface 210 provided on the base portion 202. Once the elongate portion 250 is disposed within the opening 116 of the loop portion 114, as shown in FIG. 9, the base portion 202 may be pivoted upwardly and away from the rear surface 158 of the back wall 154 of the package, and then downwardly and toward the rear surface 158 (upon reaching the apex of the arc of motion X1) until the engagement surface 210 of the base portion 202 contacts and engages the lock member 260 of the elongate portion 250, as shown in FIG. 10. For example, the engagement surface 210 may snap under a correspondingly configured lip or detent provide on the lock member 260. Alternatively, the engagement surface 210 may be retained in a correspondingly configured recessed area on the lock member 260, such as by friction fit. Thus, it should be understood that various mechanisms may be employed to releasably secure the distal end portion 256 of the elongate portion 250 to the base portion 202.

The elongate portion 250 is pivotally movable between a position P1 extending outwardly from and substantially planar with the base portion 202 (as shown in FIGS. 8 and 9), and another position P2 spanning across the opening 208 of the base portion 202 (as shown in FIG. 10). Given the diameter d2 of the base portion 202 (and the length d3 of the elongate portion 250) is greater than the length d5 of the slot 170, the fastener device 200 may not be pulled through the slot 170 from the rear surface 158 to the front surface 156 of the back wall 154. Thus, the loop portion 114 is retained within the slot 170 and secured to the elongate portion 250 of the fastener device 200, so that the toy 100 is releasably secured to the support portion 152 of the package 150.

Figure 11:
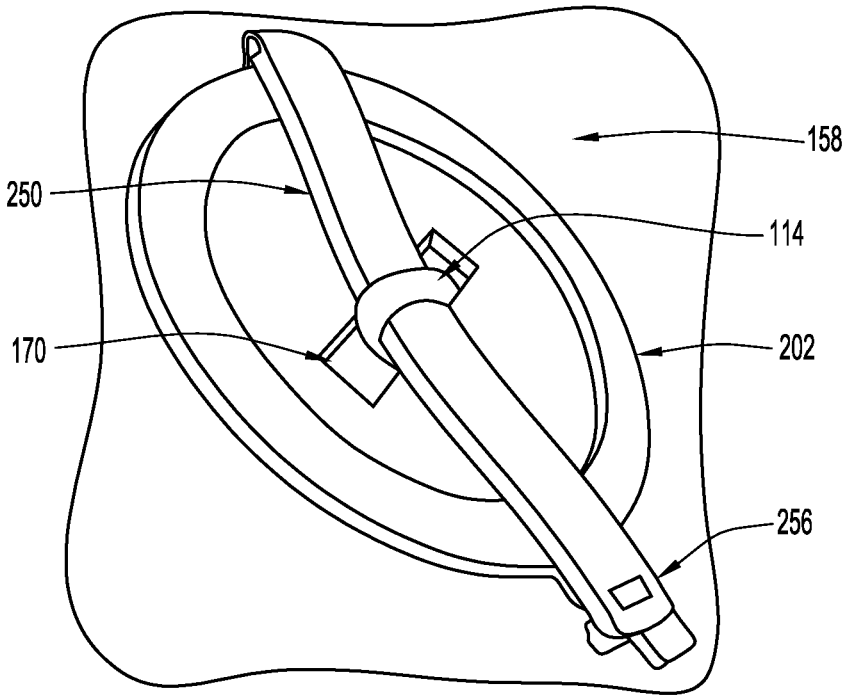
FIG. 11 illustrates a side perspective view of a different method of using the fastener device of FIG. 7 showing an engagement surface of the base portion releasably secured to a lock member of the elongate portion.
Figure 12:
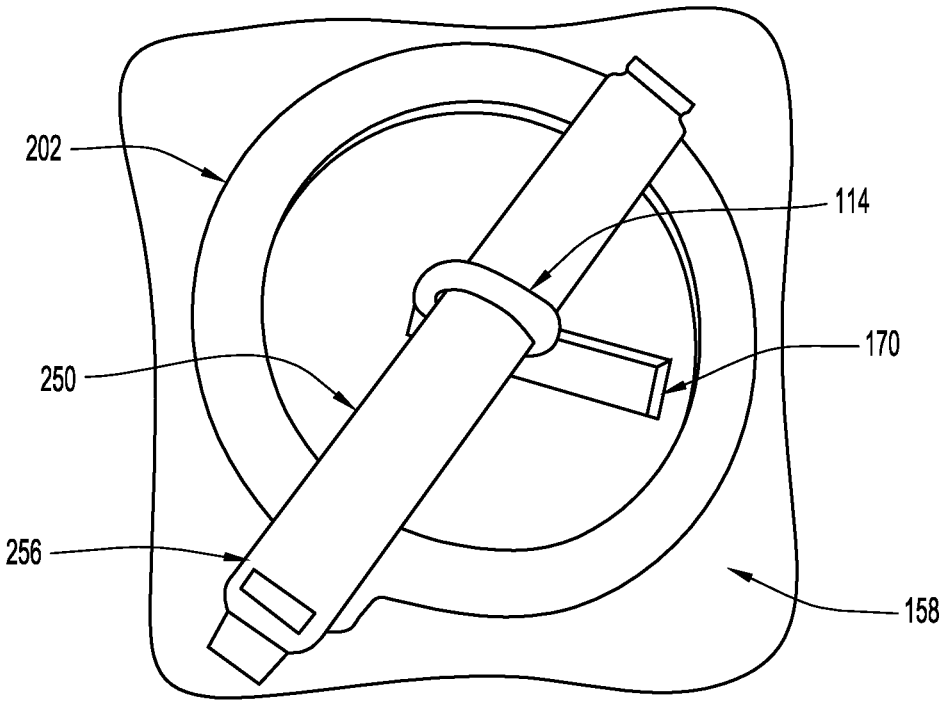
FIG. 12 illustrates a front perspective view of the fastener device of FIG. 11 showing an engagement surface of the base portion releasably secured to a lock member of the elongate portion.

FIGS. 11 and 12 illustrate a side perspective view of a different method of using the fastener device of FIG. 7 showing an engagement surface of the base portion 202 releasably secured to a lock member 260 of the elongate portion 250. In this method, the base portion 202 is placed against the rear surface 158 of the package (with the fastener device 200 in the open position illustrated in FIG. 7). The opening 208 of the base portion 202 (see FIG. 7) is placed over the loop portion 114 of the toy. The elongate portion 250 may then be pivoted upwardly and away from the rear surface 158 of the back wall 154 of the package, and due to the flexible nature of the elongate portion 250, the elongate portion 250 can be passed though the opening 116 of the loop portion 114. Finally, the distal end portion 256 of the elongate portion 250 may be pivoted into locking engagement with the base member 202 (where the engagement surface 210 of the base portion 202 contacts and engages the lock member 260 of the elongate portion 250). Thus, the loop portion 114 is retained within the slot 170 and secured to the elongate portion 250 of the fastener device 200, so that the toy 100 is releasably secured to the support portion 152 of the package 150. With the configuration of FIGS. 11 and 12, the entirety of the base portion 202 may directly contact the rear surface 158 of the package which provides additional stability over the arrangement of the fastener device 200 shown in FIG. 10.

Although the disclosed inventions are illustrated and described herein as embodied in one or more specific examples, it is nevertheless not intended to be limited to the details shown. In addition, various features from one of the embodiments may be incorporated into another of the embodiments.

For example, the slot 170 is illustrated and described as being disposed in the back wall 154 of the support portion 152. However, in alternative embodiments, the slot 170 may be disposed in other areas of the support portion 152 depending on the configuration of the package 150 and/or the configuration of the toy 100. Thus, the specific configuration of the package 150 and/or of the toy 100 may vary. In some embodiments, the toy 100 is a plush toy with a flexible loop portion 114 sewn or coupled thereto. In alternative embodiments, the toy 100 (and/or its loop portion) includes relatively rigid components. Further, the loop portion may be permanently fixed to the toy, or alternatively releasably secured to the toy and intended to be decoupled after removing the toy from the associated package.

Further, although a single a fastener device 200 (or lock mechanism 60) is illustrated, it should be understood that more than one fastener device 200 (or lock mechanism 60) may be employed for securing the toy to the package. In addition, the specific configuration of the base portion 202 and/or the elongate portion 250 of the fastener device 200 may vary. For example, in alternative embodiments, the base portion 202 may have a configuration different than the generally circular configuration illustrated in FIGS. 7-10 (e.g., such as oval, square, rectangular, triangular, etc.). Similar, the elongate portion 250 may have an alternative configuration to the generally rectangular configuration illustrated in FIGS. 7-10 (e.g., such as oval, triangular, circular, etc.).

Thus, various modifications and structural changes may be made herein without departing from the scope of the inventions and within the scope and range of equivalents of the claims. Accordingly, it is appropriate that the appended claims be construed broadly and in a manner consistent with the scope of the disclosure as set forth in the following claims.

What is claimed is:

1. The combination of a toy housed in a point of sale package, comprising:

a toy having a main body and a loop portion connected to the main body; and a point of sale package for the toy including, a support portion for supporting the toy in the package, the support portion having a slot, the loop portion of the toy extending through the slot, and a fastener device including:

an elongate portion extending through the loop portion of the toy so that the toy is releasably secured to the support portion of the package; and a base portion pivotally coupled to the elongate portion, the base portion having a generally circular configuration, and the elongate portion including a distal end portion releasably securable to the base portion.

2. The combination or a toy housed in a point of sale package of claim 1, wherein the base portion of the fastener includes an engagement surface, and the distal end portion of the elongate portion includes a lock member releasably securable to the engagement surface.

3. The combination of a toy housed in a point of sale package of claim 1, wherein the elongate portion of the fastener is pivotally coupled to the base portion via a living hinge.

4. The combination of a toy housed in a point of sale package of claim 1, wherein the support portion of the package includes first and second opposing surfaces, the main body of the toy being disposed adjacent and extending outwardly from the first surface and the loop portion of the toy being adjacent and extending outwardly from the second surface.

5. The combination of a toy housed in a point of sale package of claim 4, wherein the elongate portion engages the second surface of the support portion.

6. A combination of a toy housed in a point of sale package, comprising:

a toy having a main body and an extension member connected to the main body, wherein the extension member is a loop; and a point of sale package for the toy including, a support portion having first and second opposing surfaces and a slot extending therethrough, the main body of the toy being disposed adjacent and extending outwardly from the first surface of the support portion and the extension member of the toy extending through the slot and outwardly from the second surface, and a lock mechanism including a lock ring and an elongate portion pivotally coupled to the lock ring, the lock mechanism being releasably coupled to the extension member of the toy so that the toy is releasably secured to the support portion.

7. The combination of a toy housed in a point of sale package of claim 6, wherein the lock ring is integrally formed with the elongate portion.

8. The combination of a toy housed in a point of sale package of claim 6, wherein the elongate portion is pivotally coupled to the lock ring via a living hinge.

9. The combination of a toy housed in a point of sale package of claim 6, wherein the lock ring has a diameter and the slot in the support portion of the package has a length less than the diameter of the lock ring.

10. A point of sale packaging assembly, comprising:

a support portion supporting a toy, the support portion having first and second opposing surfaces and a slot extending therethrough, the slot receiving a looped extension member of a toy; and a fastener device including an elongate portion and a base portion pivotally coupled to the elongate portion, the elongate portion including a distal end portion releasably securable to an engagement surface on the base portion, the elongate portion configured to be received through the looped extension member of the toy so that the toy is releasably coupleable to the support portion.

11. The point of sale packaging assembly of claim 10, wherein the elongate portion is coupled to the base portion of the fastener and pivotal about an arc of about 180° .

12. The point of sale packaging assembly of claim 10, wherein the base portion of the fastener has a generally circular configuration and having a diameter, and the elongate portion has a length greater than the diameter of the base portion.

13. The point of sale packaging assembly of claim 12, wherein the slot in the support portion has a length less than the diameter of the base portion of the fastener.

14. The point of sale packaging assembly of claim 12, wherein the elongate portion is pivotally movable between a first position extending outwardly from the base portion, and a second position spanning across the diameter of the base portion.

15. The point of sale packaging assembly of claim 10, wherein the elongate portion is pivotally coupled to the base portion via a living hinge.

16. The point of sale packaging assembly of claim 10, wherein the base portion engages the second surface of the support portion.

* * * * *

UNITED STATES PATENT AND TRADEMARK OFFICE

CERTIFICATE OF CORRECTION

PATENT NO. : 8,657,116 B2
APPLICATION NO. : 13/160550
DATED : February 25, 2014
INVENTOR(S) : Buresch et al.

It is certified that error appears in the above-identified patent and that said Letters Patent is hereby corrected as shown below:

In the Specification:

Column 1, line 32, change “resealable” to --resalable--.

In the Claims:

Column 6, line 39, (claim 2, line 1), change “or” to --of--.

Signed and Sealed this
Fifteenth Day of July, 2014

Michelle K. Lee

Michelle K. Lee
*Deputy Director of the United States Patent and Trademark Office*